US006637245B1

(12) United States Patent
Bolton

(10) Patent No.: US 6,637,245 B1
(45) Date of Patent: Oct. 28, 2003

(54) METHODS OF MAKING KEY ASSEMBLIES

(75) Inventor: Brian L. Bolton, Kirksville, MO (US)

(73) Assignee: Ortech Co., Kirksville, MO (US)

( * ) Notice: Subject to any disclaimer, the term of this patent is extended or adjusted under 35 U.S.C. 154(b) by 0 days.

(21) Appl. No.: 10/039,925

(22) Filed: Oct. 29, 2001

Related U.S. Application Data

(62) Division of application No. 08/948,180, filed on Oct. 9, 1997, now Pat. No. 6,308,542.

(60) Provisional application No. 60/048,545, filed on Jun. 3, 1997, and provisional application No. 60/028,308, filed on Oct. 11, 1996.

(51) Int. Cl.[7] ..... E05B 19/04

(52) U.S. Cl. ..... 70/408; 70/278.3; 70/460

(58) Field of Search ..... 70/395, 408, 278.3, 70/397, 256, 277, 279.1, 413, 458, 460

(56) References Cited

U.S. PATENT DOCUMENTS 3,883,629 A * 5/1975 Garner et al. ..... 264/55
4,389,063 A * 6/1983 Ryan ..... 40/626 X
4,768,362 A * 9/1988 Schmalz, Jr. ..... 70/408
5,038,590 A * 8/1991 Sawyer et al. ..... 70/408 X
5,291,768 A * 3/1994 Rieffel et al. ..... 70/460
5,311,757 A * 5/1994 Spahn ..... 70/408
5,433,096 A * 7/1995 Janssen et al. ..... 70/278
5,632,168 A * 5/1997 Yano ..... 70/278
5,727,408 A * 3/1998 Mizuno et al. ..... 70/413
5,768,925 A * 6/1998 Ozawa et al. ..... 70/408
5,974,844 A * 11/1999 Harrelson et al. ..... 70/408
6,035,677 A * 3/2000 Janssen et al. ..... 70/278.3
6,089,060 A * 7/2000 Steeley ..... 70/456 R
6,094,954 A * 8/2000 Carmen ..... 70/408
6,164,101 A * 12/2000 Kito et al. ..... 70/278.3
6,308,542 B1 * 10/2001 Bolton ..... 70/408
6,427,504 B1 * 8/2002 Janssen et al. ..... 70/278.3

* cited by examiner

*Primary Examiner*—Suzanne Dino Barrett
(74) *Attorney, Agent, or Firm*—D. D. McGraw

(57) ABSTRACT

Methods and processes of making and assembling key assemblies each having a key blank, a transponder, a transponder holder and a key head section cover molded to encapsulate the transponder and at least part of its holder. If a logo is desired on the finished key, it may be provided on one or both sides of the key head section cover, or on a transponder holder which is molded about a part of the key head section.

18 Claims, 5 Drawing Sheets

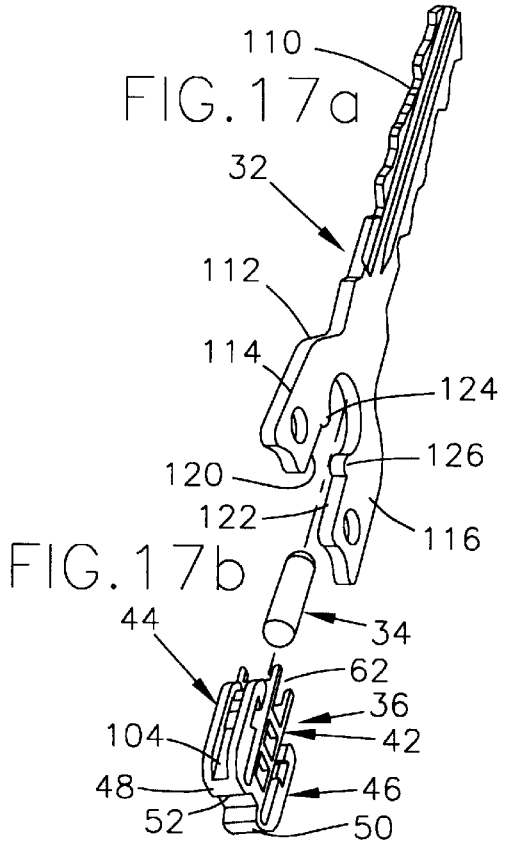
FIG.17a
FIG.17b
FIG.17c
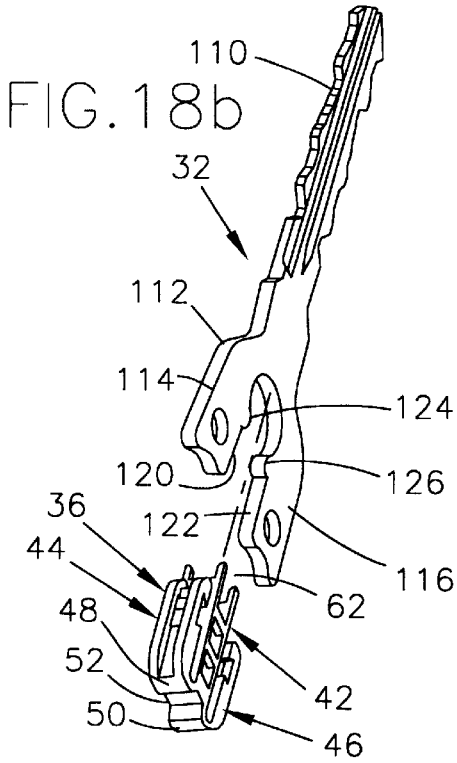
FIG.18b
FIG.18a
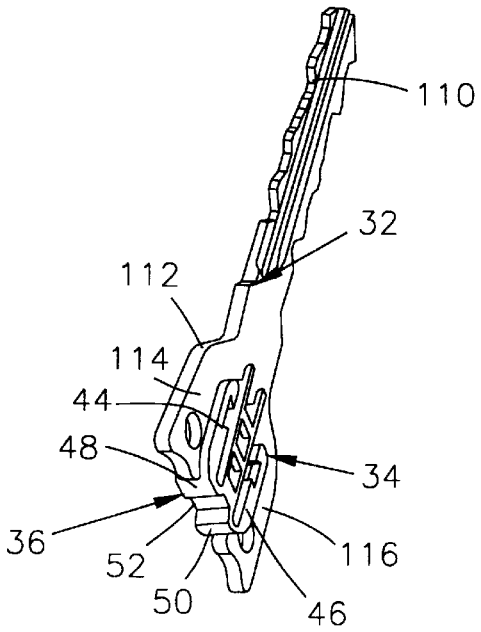
FIG.19
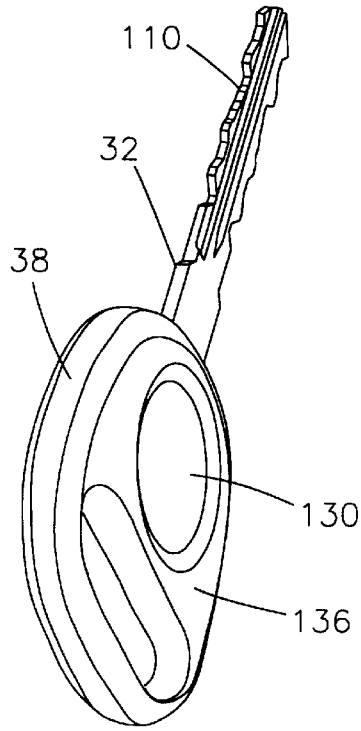
FIG.20

METHODS OF MAKING KEY ASSEMBLIES

CLAIM OF PRIORITY AND BENEFIT OF EARLIER FILING DATES

This is a divisional application, filed under 35 U.S.C. 119(e), 35 U.S.C. 120 and 35 U.S.C. 121, and more particularly is a division of U.S. patent application Ser. No. 08/948,180, filed Oct. 9, 1997, now U.S. Pat. No. 6,308,542, issued Oct. 30, 2001, and entitled, "Key Assemblies and Methods of Making Same."

The inventor of that U.S. patent application claimed priority of invention and the benefit of earlier filing dates in the United States under 35 U.S.C. 119(e) and 35 U.S.C. 120 for the invention disclosed therein in the manner provided by the first paragraph of 35 U.S.C. 112, that claim of priority and benefit of earlier filing dates being based on the disclosures of U.S. Provisional Applications Serial No. 60/028,308 filed Oct. 11, 1996, and Serial No. 60/048,545 filed Jun. 3, 1997, by the applicant Brian L. Bolton, Kirksville, Mo., who is the inventor named in that U.S. patent application as the inventor of the invention disclosed and claimed therein. Therefore, that claim of priority inures to the benefit of, and is claimed by, the inventor in this application. The above-identified Provisional Applications fully complied with 35 U.S.C. 119(e)(2).

FIELD OF THE INVENTION

The invention particularly relates to methods of making key assemblies containing an electronic transponder mounted therein in a transponder holder, and the provision of one or more logos on a completed key assembly.

BACKGROUND OF THE INVENTION

In recent years, it has become common to make and use key assemblies which have devices therein which either generate a coded signal or are sensitive to an outside code reading mechanism which reads the code contained in each key assembly's device. One such device may be an electronic transponder. A common use in recent years has been in a motor vehicle ignition key and lock arrangement.

When the key assembly is inserted in its receiving mechanism, such as an ignition key lock, the code embedded in or emitted by the transponder of the key assembly is matched with a corresponding code detector to permit the key to unlock the lock so that the vehicle engine ignition system may be actuated. Actuation of the key may also unlock a steering shaft lock which has prevented the steering wheel from being moved, and it may unlock a lock installed in an electrical circuit or a door or the like which is locked.

Should a key assembly which does not provide a proper code signal be inserted in the lock, the code detector may actuate any controlled unlocked locks. It may actuate a theft warning device, interior and/or exterior lights, and render a starter mechanism inoperative, by way of example.

Numerous patents have been issued on this general subject, the more pertinent ones known to the inventor of the invention claimed herein showing conventional transponder key assemblies being the references of record in the parent patent application and other patents and patent publications contained in the list below. This list includes some less pertinent patents and publications disclosing conventional transponder key assemblies or other broadly related arrangements being the following, listed in patent number order in the case of the U.S. patents, some of which are also references of record in the parent patent application:

U.S. Pat. Nos.: 4,200,227—Lemelson (1980); 4,257,030—Bruhin et al (1981); 4,287,735—Brunken et al (1981); 4,663,952—Gelhard (1987); 4,858,453—Namazue (1989); 4,922,736—Tanaka et al (1990); 4,924,686—Vonlanthen (1990); 4,947,662—Imedio (1990); 5,003,801—Stinar et al (1991); 5,038,590—Sawyer (U.S. Pat. No. 5,083,362—Edgar et al (1992); 5,156,032—Edgar (1992); 5,195,341—Nieuwkoop (1993); 5,307,658—Kokubu et al (1994); 5,311,757—Spahn (1994); 5,337,588—Chhatwal (1994); 5,433,096—Janssen et al (1995); 5,461,386—Knebelkamp (1995); 5,469,727—Spahn et al (1995); 5,532,522—Dietz et al (1996); 5,561,420—Kleefeldt et al (1996); 5,561,430—Knebelkamp (1996); and 5,632,168—Yano (1997).

Also, PCT International Publication No. WO 87/00234 published Jan. 15, 1987; European Patent Office published summary of a German-language application filed Jun. 26, 1991, claiming priority as of Dec. 22, 1989, and identified as Verbffentichungsnummer: 0 434 176 A1; Japanese Patent Application Publication Nos. 2-164647 (1990) and 4-11179 (1992); and UK Patent Application GB 2 155 988 A published on Oct. 2, 1985.

SUMMARY OF THE INVENTION

A method of making key assemblies embodying one aspect of the invention includes making a key blank having a particular construction on one end in which a transponder and a transponder holder are mounted, and molding a key head cover over the portion of the key blank in which the transponder and its holder are mounted. The key blank being made as a part of the methods invention has a head section and a shank section, with a portion connecting those two sections. While various key shank sections may be a part of the key blank, their precise construction is not a part of this invention. Therefore, the invention is relates to making a simple shank section connected to the head section and having a simple key profile. It is to be understood that other known key shank section shapes, both in cross section and in profile, may be made and assembled in a key assembly by practice of the methods embodying the invention. The shank section of the illustrative key made by a method embodying the invention therefore includes that part of the key typically having a profile which cooperates with the mechanical portion of the lock to release the locking mechanism when the key shank profile mates with the lock profile and the key is rotated. Such key shank sections, once cut to a specific profile, are used in most cylindrical locks of the type commonly used in automotive vehicle doors and ignition systems, as well as many keys fitting locks for doors in buildings.

More particularly relating to the inventive methods claimed, the head end of the key blank is shaped to provide a pair of legs defining, with the inner axial end of the key shank, a generally U-shaped recess configuration with the open end of the recess extending in an opposite axial direction on the key blank from the shank end of the key. The transponder holder is snap-fitted within the U-shaped recess after the transponder has been fitted within the transponder holder and is resiliently supported within that holder. The portions of the transponder holder which are engaged with the key blank legs also are resiliently connected to the portion of the transponder holder which resiliently supports the transponder.

The key blank legs are preferably provided with protrusions which mate with corresponding depressions or openings formed in the transponder holder so that the snap-fitted action of the transponder holder in relation to the legs occurs when the transponder holder is inserted into position between the key blank legs until the protrusions mate with their corresponding openings.

It is another feature of the invention that the transponder holder depressions or openings are provided within the bottom portions of channels defined along the edges of the transponder holder, with the laterally inwardly extending edges of the key blank legs being received in sliding relation in said channels as the transponder holder is moved into its snap-fitted position within the U-shaped recess. The side portions of the channels are so made as to engage the sides of portions of the key blank legs and minimize any movement of the holder in any direction which is substantially perpendicular to the direction of sliding movement assembly of the transponder holder to the legs of the key blank. This is particularly important from the time that the transponder and its holder are inserted in place in the key blank until the key head cover is molded about the key head and the transponder and its holder, permanently securing them in place in relation to the key head.

Another feature of the invention is provided wherein the transponder holder is fabricated of a suitable plastic material which is sufficiently stiff at its channels and at its transponder mounting section to hold the transponder in a precisely defined position in the key blank while also having resilient sections which provide a resilient mounting arrangement between the transponder and its mounting section and also provides a resilient mounting arrangement between the transponder mounting section and its channels. It is particularly desirable, and is a feature of the methods constituting the invention that is preferably practiced, wherein the transponder mounting section of the transponder holder is resiliently supported in cantilever spring fashion by the transponder holder legs and their spring connections to the transponder mounting section. This resilient support is particularly advantageous when the transponder and its holder are assembled together and handled as a subassembly before being installed into the key blank head section having the U-shaped recess, as well as the subassembly of the transponder, transponder holder and the key blank before the key head in molded in place.

Another feature of the invention resides in the molding of the key head cover over the key head end, including legs and the end of the key shank forming the bottom of the U-shaped recess, and over the transponder holder and the transponder within it, securing them in position in the key head.

In another aspect of the invention, the transponder holder is molded in place between and over portions of the key head, including the key blank legs, creating a first subassembly. The transponder and a transponder retaining plug are then inserted into the molded transponder holder, forming a second subassembly including the molded transponder holder and the key blank. The key head cover is then molded in place over portions or all of the transponder holder and the key head, providing a key chain slot and sealing the transponder and its plug in place.

In one variation of this aspect of the invention, during the molding operation of the transponder holder, a suitable logo is integrally molded on its side surfaces. Then, when the key head cover is molded over only portions of the transponder holder, leaving an opening over each logo. The side surfaces of the holder constituting the logo remain uncovered and the logo remains visible even though the material from which the key head cover is molded is opaque. When the material from which the key head cover is transparent upon completion of its molding process and the key head cover is molded over the entire transponder holder, or when the key head cover is molded with one or more transparent windows corresponding to the one or more logos molded on the transponder holder side surfaces, those logos will remain visible through those transparent windows.

In another variation, the key head cover is molded with externally facing recesses on its side surfaces, and discs with logos thereon are secured in those recesses. This permits the logos to be installed at a later time, well after the date of manufacture of the key assembly, if desired.

The manner of assembling the various parts of each of the various key assemblies embodying the invention into an integrated whole is a feature of, the invention herein claimed, as well as the process of making of the key assemblies.

Other features and objects of the invention may be ascertained from the disclosure and the claims herein.

BRIEF DESCRIPTION OF THE DRAWINGS

FIG. 17*a* is an isometric view of the key blank shown in FIGS. 14–15, positioned to illustrate, with FIGS. 17*b* and 17*c*, one or more steps in the process of making the key assembly of FIGS. 1–5 by assembling the parts in the order described.

FIG. 17*b* is an isometric view of the transponder also shown as a part of the subassemblies of FIGS. 11–13 and 16.

FIG. 17*c* is an isometric view of the transponder holder of FIGS. 6–10 and also shown as a part of the subassemblies of FIGS. 11–13 and 16.

FIG. 18*a* is identical to FIG. 17*a*, and is also an isometric view of the key blank shown in FIGS. 14–15, positioned to illustrate, with FIG. 18*b*, another step in the process of making the key assembly of FIGS. 1–5 by assembling the parts in the order described, that step being a step of a method or process embodying the invention.

FIG. 18*b* is an isometric view of the subassembly of FIGS. 11 and 12 after the step of forming that subassembly has been taken. It is positioned in relation to the key blank of FIG. 18*a* to show the relationship between the subassembly and the key blank immediately before the next assembly step is taken.

FIG. 19 is an isometric view of the subassembly of FIGS. 13 and 16 when the step of inserting the subassembly of FIG. 18*b* into the space provided in the key blank of FIG. 18*a* has been completed.

FIG. 20 is an isometric view of the key assembly of FIGS. 1–5 after the step of molding the key head cover in place has been completed.

DETAILED DESCRIPTION OF THE EMBODIMENTS OF THE INVENTION

Figure 1:
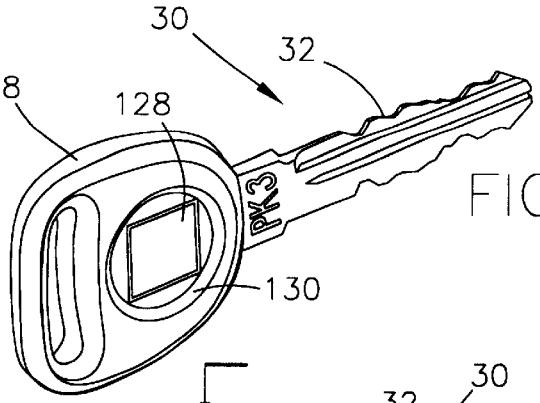
FIG. 1 is an isometric view of a key assembly which is made by a method embodying the invention.

The following portion of this detailed description relates to the disclosures in FIGS. 1 through 20. It is to be understood that by the practice of a method or process embodying the invention herein disclosed and claimed may be used to manufacture any parts or all of the key assemblies disclosed herein, but that such methods or processes are not limited only to making such specific key assembly parts or key assemblies.

The key assembly 30 includes a key blank 32, a transponder 34, a transponder holder 36, and a key head cover 38. The transponder 34 is illustrated as being shaped much like a medical capsule in that it has a cylindrical body and rounded ends.

The specific construction of the holder 36 is that of a holder body 40 adapted to having the transponder 34 held therein and comprising a transponder-mount section 42 and legs 44 and 46, legs 44 and 46 respectively having a reversely-bent spring section 48, 50 attached to one end 52 of the transponder mount section 42. The legs 44 and 46 extend in substantially parallel spaced relation to and on opposite sides 54 and 58 of the mount section 42.

The transponder mount section 42 is an open-framed cage construction defining a transponder retention space having an opening 62 at its open end 64 and a closed end 66 at its end 52. The sides 54 and 58 of the transponder mount section 42 are shown as being solid, with longitudinally open-ended notches 68 and 70 respectively formed in the ends thereof forming the mount section open end 64. As will be seen, these notches fit over part of the key blank and laterally and longitudinally locate the holder in relation to the key blank when the holder is inserted into position on the key blank head.

The open-framed cage construction defining the transponder retention space in the transponder mount section 42 is formed by the spaced-apart mount section sides 54 and 58 and cross pieces 72, 74, 76, 78 and 80 joining the sides 54 and 58. The two cross pieces 72 and 74 join the lateral edges 82 and 84 of sides 54 and 58 and form one ladder-like open side 56 of the mount section 42, and the other cross pieces 76, 78 and 80 join the opposite lateral edges 86 and 88 of sides 54 and 58 and form the other ladder-like open side 60 of the mount section 42. These cross pieces extend laterally of the transponder mount section 42 and are spaced longitudinally of that section between the section ends 52 and 64. It is to be understood that more than two cross pieces may be used on either or both sides 56 and 60, and that the number of cross pieces on side 56 of the mount section 42 may be or may not be identical in number to those on the side 60 of the mount section 42. In the construction shown, there are fewer cross pieces forming open side 56 than there are forming open side 60 and none of them are laterally aligned in the same cross plane.

The transponder holder mount section 42 and the transponder 34 are so sized relative to each other that when the transponder 34 is inserted therein the transponder fits tightly within the mount section 42, passing through the mount section end opening 62 so that one transponder end 98 engages the closed end 66 of the mount section. The cross pieces 72, 74, 76, 78 and 80 provide laterally yieldable mount section sides 56 and 60. They are slightly flexible yet stiff so that can be bent slightly outward by the cylindrical body of the transponder 34 as the transponder is inserted if the spaces between sides 56 and 60 are very slightly less than the diameter of the transponder cylindrical body. Such bending slightly shortens the space between the mount section solid sides 54 and 58, either causing or increasing the gripping force acting on the transponder 34 that is present when the transponder is inserted into the mount section. This provides a tight yet resilient fit that is sufficient to hold the transponder 34 in position in the transponder mount section 42 of holder 36 while the two, in assembled relation, are a subassembly which is thereafter assembled into the key blank head section 112 of course, a sufficiently tight fit may be obtained by having the effective width and/or the height of the transponder-receiving space be equal to but no greater than, or only slightly less than, the diameter of the transponder cylindrical body.

Both of the legs 44 and 46 of the key transponder holder 36 are constructed in the same manner, and therefore the reference numerals identifying various parts thereof are the same. Leg 44 will be described in detail, and the same description and reference numbers where used are understood to equally apply to leg 46.

Leg 44 includes sides 90 and 92 respectively located in the planes of the sides 56 and 60 formed by the cross pieces 72, 74 and the cross pieces 76, 78 and 80. The leg sides 90 and 92 are joined by a bottom 94 which on one end is effectively an extension of the reversely-bent spring section 48 for leg 44 and 50 for leg 46. Bottom 94 is laterally spaced from the transponder mount section 42, allowing the legs 44 and 46 to bend toward as well as away from the transponder mount section side 54 in a cantilever manner during installation of the transponder 34 and the transponder holder 36 in the key blank 32 as a subassembly (later described), the bending taking place in the spring sections 48 and 50. A notch 96, of generally trapezoidal shape when viewed in elevation, is formed in leg 44 so that the leg sides 90 and 92 have the trapezoidal shape of the notch and the leg bottom 94 has the notch opening therethrough, effectively dividing the bottom 94 into two parts and causing the outer end 98 of the leg to be hook-shaped as seen in side elevation.

The leg bottom 94 does not extend to the outer edges 100 and 102 of the leg sides 90 and 92. Thus, the bottom 94 and the sides 90 and 92 define an open channel 104 extending throughout the length of the leg 44. Channel 104 is open-ended and has its open longitudinally-extending side opening away from the transponder mount section 42. The end of each bottom 94 opposite its spring section 48 or 50 is beveled as shown at 106 so that the end opening of channel 104 is inwardly enlarged and the beveled surfaces at 106 can act as cam surfaces as will be later described.

The transponder 34, once mounted in the mount section 42, is resiliently mounted relative to the key blank 32 because of the cantilever spring sections 48 and 50 which resiliently support the mount section and the transponder on the key blank head section legs 114 and 116 until the head cover 38 is molded about them and solidifies about them. Therefore, this resilient mounting arrangement is active from the time that the transponder is installed in the mount section, through the time that the subassembly transponder and holder are inserted into the key blank head section, until the head cover is molded and solidified to anchor all of these parts in place.

The key blank 32, shown FIGS. 1–5, 13–16, 17*a*, 18*a*, 19 and 20, has a shank section 110 and a head section 112. The shank section may be of any suitable key configuration for mechanically locking and unlocking a typical lock using a key. Thus, it may have various longitudinal grooves as well as edge notches of various shapes, sizes and depths which cooperate with various mechanical parts of a lock to open it mechanically. This well-known arrangement forms no part of the invention herein disclosed, and therefore is not further described. The head section 112 is generally U-shaped, and has a pair of legs 114 and 116 which have their outer portions positioned parallel to each other. Legs 114 and 116 are of a thickness such that they fit snugly but in sliding relation into the channels 104 of the legs 44 and 46 of transponder holder 36 as will be further described.

It is preferable that the key blank head section legs 114 and 116 respectively have their inner edges 120 and 122 provided with protrusions 124 and 126, each protrusion extending inwardly of the U-shaped head section 112 toward the key blank axis 127. Axis 127 extends longitudinally of the key blank. These protrusions are also preferably of either a trapezoidal shape complementary to the trapezoidal shape of the notches 68 and 70, or have their edges being arcs of a circle whose radius is such that there are two points of engagement with the angled sides of the trapezoidal notches 68 and 70 into which they extend when the assembly of the mount section with its transponder is accomplished.

The transponder-and-holder subassembly, formed by the transponder 34 and the holder 36 with the transponder received within the holder mount section as above described, is inserted into the open end of the head section 112 with the channels 104 receiving the inner edges and longitudinally adjacent portions of the legs 44 and 46. As the holder is moved into the U-shaped opening, the beveled ends 106 of the channel bottoms 94 engage the complementary angled surfaces provided by the complementary trapezoidally shaped protrusions 124 and 126, camming the holder legs 44 and 46 inwardly in cantilever fashion toward the transponder mount section 42 until the protrusions 124 and 126 fit into their mating notches 96, at which time the holder legs 44 and 46 spring outwardly in cantilever fashion so that the arcuate or beveled sides of the protrusions 124 and 126 and the angled sides of the notches 96 are in mating engagement, precisely locating the subassembly of the holder 36 and the transponder 34 longitudinally in the key head section 112.

While the protrusions 124 and 126 are not absolutely necessary, they are very desirable because, in cooperation with the notches 96 of the transponder holder legs 44 and 46 and in concert with the notches 68 and 70 of the transponder mount section 42, they provide a more precise and secure installation of the transponder and transponder holder subassembly as the key assembly is being assembled. When the protrusions are omitted, the precise longitudinal location of the holder within the key head section would be determined only by other means such as a precise abutment provided on the key blank head section which is engaged by the bottoms of notches 68 and 70 or leg ends 98. If the leg end 98 are so utilized, they would then need to have flat end surfaces instead of end surfaces which are curved in the manner shown. Also, the fitting of the legs 44 and 46 in the channels 104 would then have to be more precise to assure a tight fitting retention after the transponder-holder subassembly is in place in the key head section so that the subassembly remains in its proper position until the head cover is molded in place and hardened.

FIGS. 17*a* through 20 illustrate the process or method of assembling the key assemblies of FIGS. 1 through 16. In FIGS. 17*a*, 17*b* and 17*c*, three basic parts are illustrated in an exploded view arrangement. Each part is manufactured separately and may even be made at different locations. The key blank 32 need not have the notches cut in the key shank 110 until some later time after the entire key assembly is completed. Typically, the shank part of each key assembly would be made to fit one of a series of specific locks which sense and match the code signals of a transponder 34 of the particular key assembly.

Figure 11:
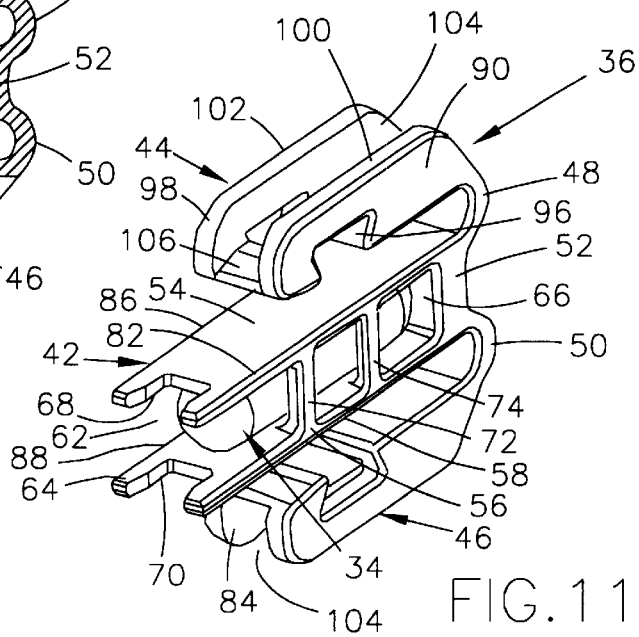
FIG. 11 is an isometric view of a subassembly of the transponder holder of FIGS. 6–10 and a transponder installed in the transponder holding portion of the transponder holder, made by one or more steps of a method embodying the invention.
Figure 12:
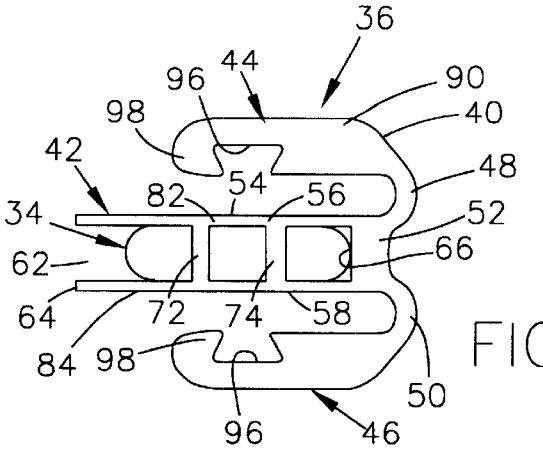
FIG. 12 is a side elevation view of the subassembly of FIG. 11.
Figure 13:
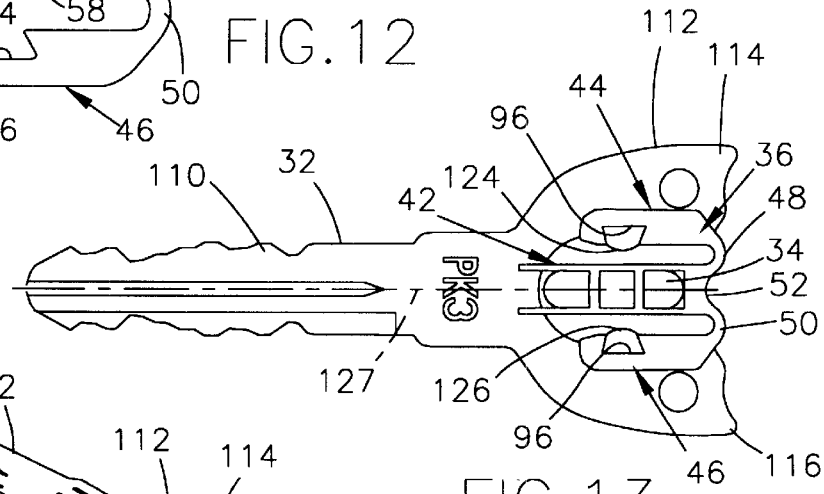
FIG. 13 is a side elevation view of another subassembly comprising the subassembly of FIGS. 11–12 and a key blank. The transponder and transponder holder subassembly is shown in its designated position in the key blank, and this subassembly is made in accordance with a method embodying the invention.
Figure 14:
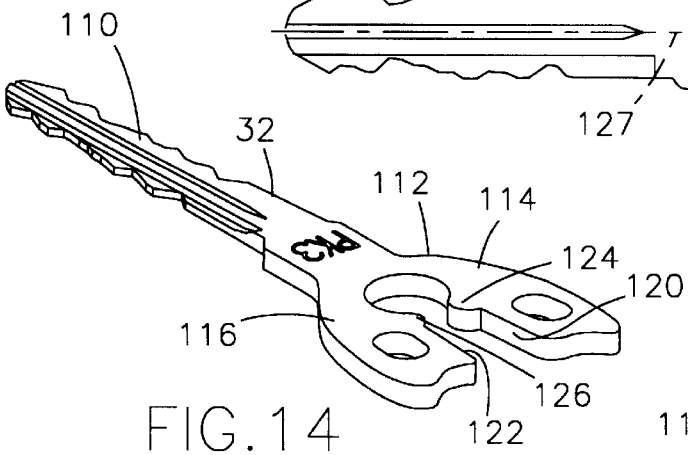
FIG. 14 is an isometric view of a key blank such as the one shown as part of the subassembly of FIG. 13, the making of which is the subject of at least a step of a method embodying the invention.
Figure 15:
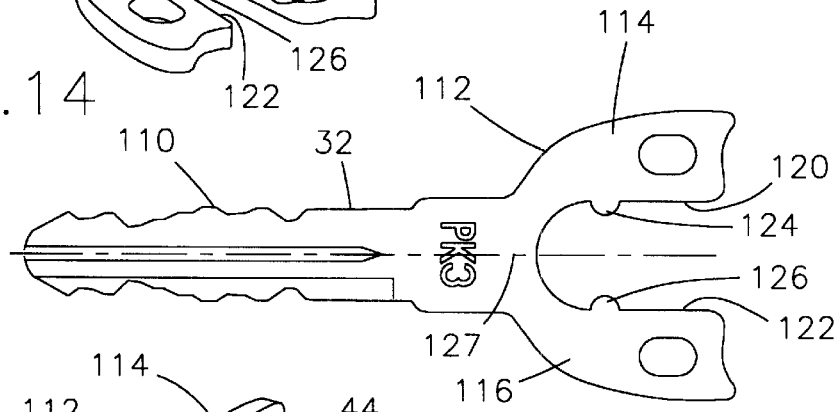
FIG. 15 is a side elevation view of the key blank of FIG. 14.
Figure 16:
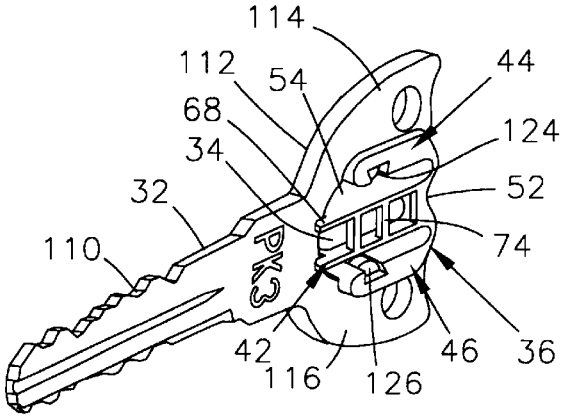
FIG. 16 is an isometric view of the subassembly shown in FIG. 13.
Figure 21:
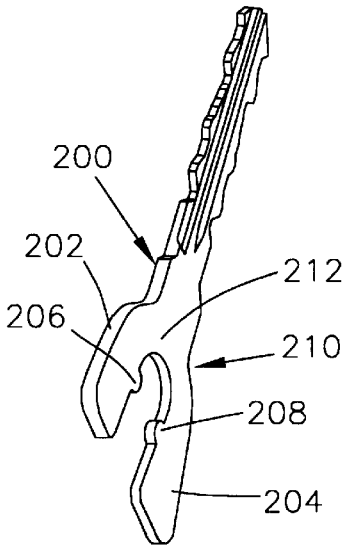
FIG. 21 is an isometric view of a key blank of the type shown in FIGS. 17*a* and 18*a*, the making of this key blank being the first step in the manufacture of a modified key assembly shown in FIG. 25.

In FIGS. 18*a* and 18*b*, the transponder 34 has been inserted into the transponder holder 36 to form a subassembly shown in FIG. 18*b*. This is the same subassembly as is shown in FIGS. 11 and 12. Since the resilient ladder-like open sides 56 and 60 of the transponder grip the transponder and retain it in the holder, these subassemblies may be transported, stored, and made available for assembly into the key blanks as needed. A separate retainer plug is not required.

FIG. 19 shows the completion of the next step in the assembly process, which is that of inserting the transponder-holder subassembly into the generally U-shaped opening formed by the legs 114 and 116 of the key blank 32. This is accomplished by slidably receiving the inner surfaces of legs 114 and 116 from which protrusions 124 and 126 extend in the channels 104 of each transponder holder leg 44 and 46 and sliding the transponder-holder subassembly into position. This position is attained by the fitting of the notches 68 and 70 to the key blank 32 and by a camming action of the bevel sections 106 of the channel bottoms 94 engaging the curved (and usually semi-circular) protrusions 124 and 126, forcing the legs 114 and 116 to resiliently bend at 48 and 50 in cantilever fashion toward the transponder mount section 42 as the bottoms 94 of the channels 104 pass the protrusions. When the openings in the channel bottoms formed by notch 96 reach the protrusions 124 and 126, the legs spring back as the protrusions extend into the notch openings in the channel bottoms. Because the location of the notch openings longitudinally of the transponder holder are precisely located in the molding process by which the transponder holders are formed, each of the protrusions 124, 126 engages both edges of the opening with which it is engaged, precisely locating the transponder-holder subassembly in the key blank 32 and retaining the subassembly in its desired position so that the transponder 34, once fully coded with its own identification code which is matched to a code sensor associated with or forming a part of a particular lock, can later be sensed and its code identified by appropriate sensing and code identification equipment. Thus the subassembly consisting of the key blank 32, the transponder 34 and the transponder holder 36 has been formed in this process step.

Figure 2:
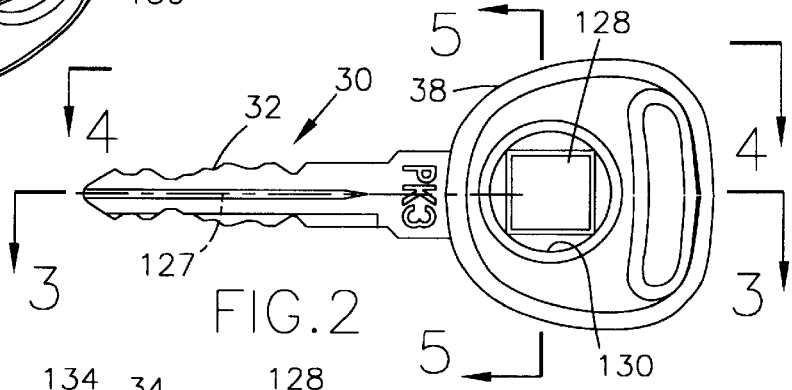
FIG. 2 is a side elevation view of the key assembly of FIG. 1.
Figure 3:
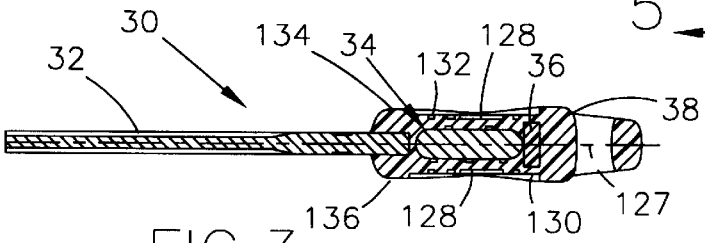
FIG. 3 is a cross section view of the key assembly shown in FIG. 2, taken in the direction of arrows 3—3 of that FIGURE.
Figure 4:
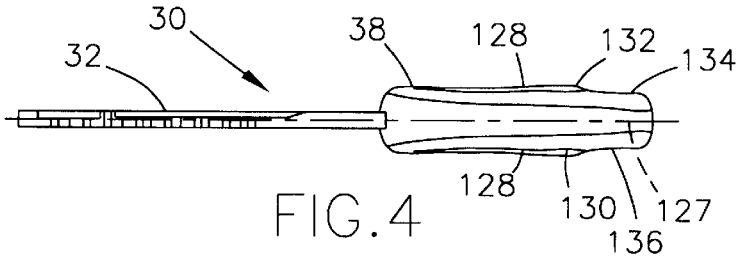
FIG. 4 is a cross section view of the key assembly shown in FIG. 2, taken in the direction of arrows 4—4 of that FIGURE.
Figure 5:
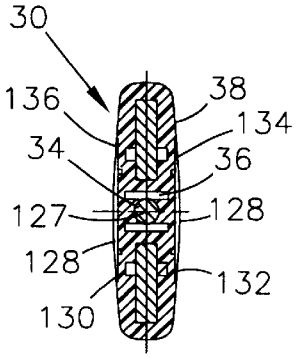
FIG. 5 is a cross section view of the key assembly shown in FIG. 2, taken in the direction of arrows 5—5 of that FIGURE.
Figure 6:
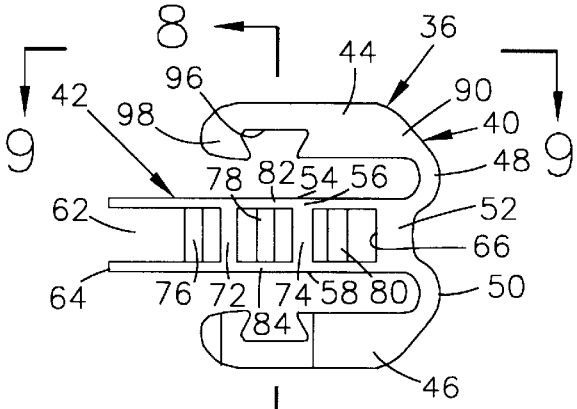
FIG. 6 is a side elevation view of the transponder holder which is a part of the key assembly of FIGS. 1–5.
Figure 7:
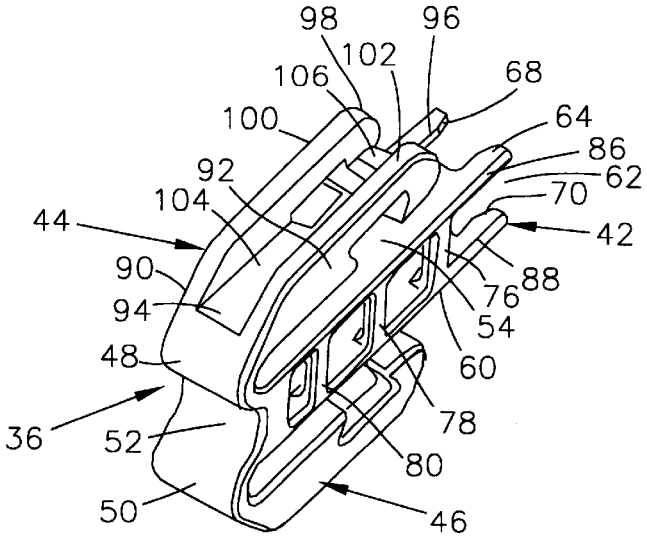
FIG. 7 is an isometric view of the transponder holder of FIG. 6.
Figure 8:
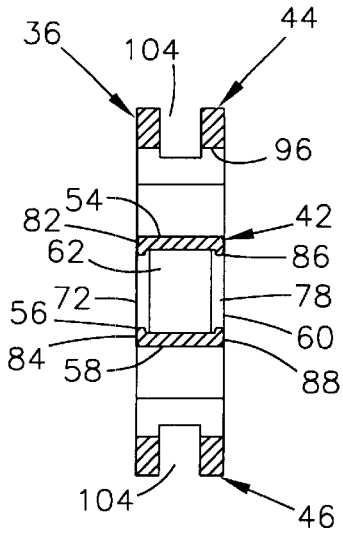
FIG. 8 is a cross section view of the transponder holder illustrated in FIG. 6, taken in the direction of arrows 8—8 of that FIGURE.
Figure 9:
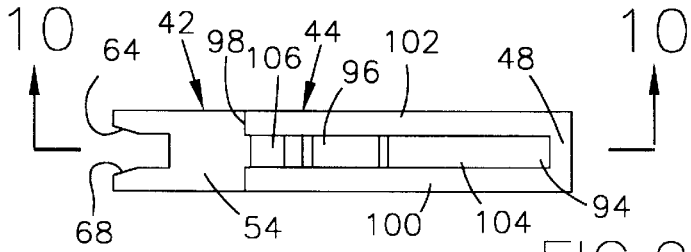
FIG. 9 is an elevation view of the transponder holder shown in FIG. 6, taken in the direction of arrows 9—9 of that FIGURE.
Figure 10:
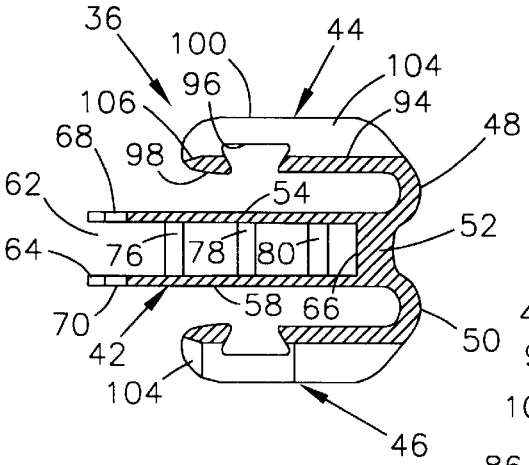
FIG. 10 is a cross section view of the transponder holder shown in FIG. 6, taken in the direction of arrows 10—10 of that FIGURE.

The head section of the subassembly just made is then placed in a mold and suitable plastic is molded about it to form the key head cover 38. In this molding operation, the plastic fills the voids about the transponder, the transponder holder and the key blank portions covered by the cover. The filled voids are illustrated in FIGS. 3 and 5. The plastic forming the key head cover 38 hardens in place so that in effect the transponder and its holder are potted in place so as to be completely sealed against deleterious outside influences. The virtual integration of the key head section, the transponder holder and the transponder into the head cover as a solidified unit effectively prevents disassembly and reassembly of the transponder and its holder without destruction of one or both of them. Thus this process step results in the finished key assembly 30 shown in FIG. 20 as well as in FIGS. 1–5.

A logo disc or wafer 128 has the logo design printed on the disc or wafer or a thin sheet of suitable material. By way of example, the logo may be used to identify a particular make or model of a vehicle or to identify to the desired extent any other product or device with which the key assembly may be associated. The logo disc or wafer or thin sheet of suitable material 128 on which the logo design is provided may be molded or later secured in place in the depressions 130 and 132 formed in the side surfaces 134 and 136 of the key head cover. FIGS. 1 and 2 illustrate such a logo design in the form of a square. This can be done concurrently with the molding which forms the key head cover 38. Alternatively, the disc or wafer containing the logo design may be secured in place after the key assembly is formed as it appears in FIG. 20 by an appropriate adhesive.

Figure 25:
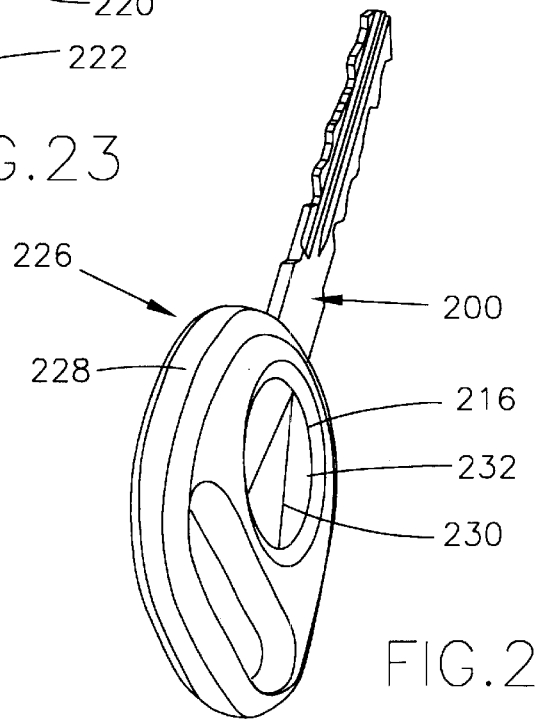
FIG. 25 is an isometric view of a modified key assembly manufactured and assembled as shown in FIGS. 21 through 24 and then having the key head cover molded in place over the transponder and the transponder plug, and over either part or all of the transponder holder.

The logo design shown in FIGS. 22, 23, 24 and 25 may be molded in place using a disc or wafer containing the logo design. Alternatively, the logo as shown in FIG. 25 may be a design on a disc or wafer or other suitable material which is later secured in place in the recess formed in the key head cover as discussed above with regard to FIG. 20.

The key head section cover 38, shown as a part of the completed key assembly 30 in FIGS. 1–5 and 20, is preferably made of a plastic selected from the group consisting of polypropylene, polyvinylchloride (PVC) such as plastized PVC, PC, ABS, SANTOPRENE™ compounds, and alloys and compounds thereof, among others. The selected plastic should be of a suitable color and cosmetic appearance with a surface having a pleasing tactile feel. Normally, the key head is molded over the assembled transponder-holder-key blank head section at a pressure up to a maximum of about 350 bar and a temperature up to a maximum of about 410° F., or less, depending upon the characteristics of the molding plastic being used. These approximate maximum values adequately protect the transponder as well as the transponder holder during the molding operation. Of course, if transponders and transponder holders are capable of withstanding higher pressures and temperatures, it is within the scope of the invention that such higher pressures and temperatures may be used when desired. The molding equipment may comprise a 40 ton vertical molding machine such as JSW Model No. JTREII-55V.

As seen in FIGS. 3 and 5, the material from which the key head cover is molded also fills any voids the transponder holder and the key blank legs, as well as around the transponder itself. It therefore forms a unitary mass when hardened which includes the transponder, the transponder holder, the key blank legs and part of the center portion of the key blank to which the legs are attached, as well as the key head cover itself.

While any suitable transponder can be utilized, desirable results have been achieved by employing one or more transponders supplied by Sokymat of Switzerland. Examples of such transponders have been used by General Motors Corporation, for example, and are identified by General Motors as DELCO part numbers 16231237 and 16232459.

While the transponder holder 36 can be molded from any suitable material, desirable results have been achieved by using an alloy comprising polycarbonate (PC) and acrylonitrile butadiend styrene (ABS). When the plug 222 of FIG. 23 is used, it is preferably made of the same material as that used to make the transponder holder.

Figure 22:
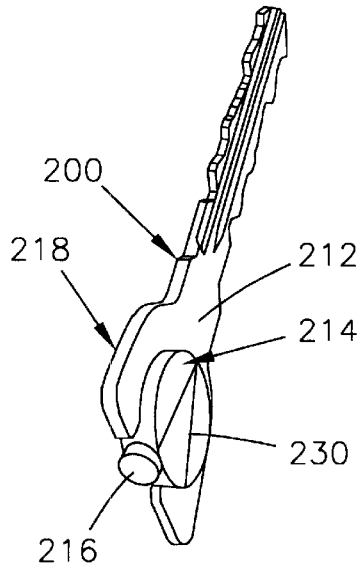
FIG. 22 is an isometric view of the results of the second step in the manufacture and assembly of a modified key assembly shown in FIG. 25. The transponder holder has been made by molding it in place on the appropriate parts of the key blank of FIG. 21.
Figure 23:
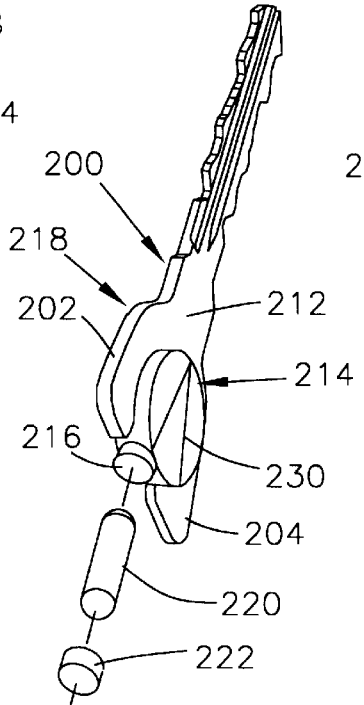
FIG. 23 is related to FIG. 22. It is an isometric view of a transponder holder, a transponder and a plug, shown in spaced relation in the order of assembly, and illustrates the third step in the manufacture and assembly of the modified key assembly shown in FIG. 25. It shows the transponder to be inserted in the transponder holder and the plug to be inserted in the transponder holder after the transponder has been inserted in place in that transponder holder.
Figure 24:
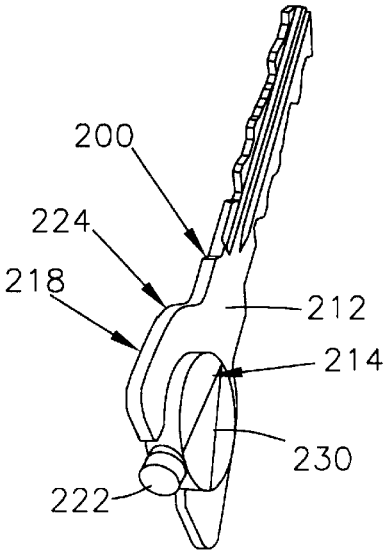
FIG. 24 is an isometric view of the subassembly of the elements of FIGS. 23 after the transponder and the plug have been inserted into the transponder holder.

Referring now to the construction and process of making the key assembly as shown in FIGS. 20–25, a similar key blank 200 is made in a first step with legs 202 and 204 having protrusions 206 and 208, all similar to comparable elements of key blank 32 shown in various ones of FIGS. 1–20. In a second step, the head section 210 of the key blank, including legs 202 and 204 and the part 212 of the key blank joining these legs, is placed in an appropriate molding machine, and the transponder holder 214 is molded in place, as shown in FIG. 22. This forms the subassembly 218 shown in FIG. 22. Holder 214 is molded with a recess 216 for receiving the transponder 220 and the plug 222, as shown in FIG. 23 illustrating the next step of making the subassembly 224 of FIG. 24. Subassembly 224 includes the subassembly 218, the transponder 220 and the plug 222. It is made by inserting the transponder 220 into the recess 216 and closing the recess open end by inserting plug 222. The plug retains the transponder 220 in the recess 216 while this subassembly 224 is transported or stored.

The head end of the subassembly 224, which is the transponder holder 214, the transponder 220, the plug 222 and the key head section 210, is placed in a suitable molding machine such as earlier identified, and the key head cover 228 is molded as shown in FIG. 25, resulting in the completed key assembly 226.

In a preferred step in this method or process, the logo 230 is molded on one or both sides of the transponder holder 214 concurrently with the molding of the holder 214. Then, the key head cover 228 may be molded with an opening 232 around each logo 230 so that the logo is visible. It is also within the purview of the invention that the key head cover 228 may be made of material which is sufficiently transparent at least in the portion over the logo 230 to cover the logo and yet keep the logo visible through that part of the head cover 228.

It is to be understood that in the use of the key with its matched lock the transponder acts, with the key inserted properly in the lock, to have an individual precoded identification signal recognized by sensing and comparison apparatus in or associated with the lock. While the specifics of transponder coding is not a part of this invention, it is recognized that it may be done in various ways and at various times between the beginning of the making of the key assembly and the actual first use of the key assembly to lock or unlock a specific lock.

The precoding of the transponder may be done before key assembly or after the key assembly is completed. In many instances, the manufacturer or user of the lock with which the key is to be used will do the individual identification precoding. Of course, if later individual key identification precoding is to be done, the transponder still has to be sufficiently precoded or programmed so as to accept that later precoding for individual key identification purposes. If the signal is the proper signal to permit the lock to be unlocked, the apparatus acts to permit that to occur. If it is not the proper signal, it will not so act.

In some instances, rejection of the transponder signal may also activate an alarm. It may also either activate such controls as other disabling apparatus further disabling the automobile engine from being started, disabling the automobile steering mechanism, and/or locking the vehicle brakes, all toward preventing the automobile to be driven or moved without authorization. This may also include lack of action to release any such disabling apparatus which is normally in the disabled mode when no authorized key is in use, therefore keeping such apparatus in the disabled condition. It may activate remote sensor and monitoring systems by radio when such systems, already in use on many vehicles, have been installed in the vehicle. In any case, access to the vehicle under control of the lock is denied.

I claim:

1. The method of making and assembling a key assembly comprising the steps of:

(a) providing a transponder;

(b) molding a transponder holder providing a mounting section for a transponder;

(c) providing a key blank having one end formed to define a generally U-shaped recess and means for receiving and mounting a transponder holder in the recess;

(d) forming a subassembly composed of the transponder, the transponder holder and the key blank and retaining the transponder in a precise location in the transponder holder and in the key blank while the subassembly may be stored and transported; and (e) placing the subassembly in a molding machine and molding a key head cover about key blank one end and the transponder holder and the transponder while concurrently filling in many voids located in the U-shaped recess with the material from which the key head cover is being molded and also concurrently molding a logo on at least one side surface of the key head cover being molded so that the logo is visible on the completed key assembly, forming the completed key assembly.

2. The method of making and assembling a key assembly comprising the steps of:

(a) providing a key blank having one end formed to define a generally U-shaped recess and means for receiving, mounting and retaining a transponder holder in the recess;

(b) providing a transponder and a transponder holder having a mounting section for receiving and mounting the transponder therein;

(d) forming a subassembly, composed of the key blank, the transponder holder and the transponder, by positioning the transponder holder in place on the one end of the key blank and in the generally U-shaped recess so as to be retained therein, and inserting the transponder in the transponder holder recess so as to be positioned in the transponder holder mounting section and then retaining the transponder in a precise location in the transponder holder mounting section and therefore in a precise location in the key blank recess while the subassembly may be stored and transported; and (f) placing the subassembly in a molding machine and molding a key head cover about the key blank one end and the transponder holder and the transponder while concurrently filling in any voids in the subassembly portion covered by the key head cover, and also concurrently molding a logo recess with the material from which the key head cover is being molded, with the material from which the key head cover is being molded, forming the completed key assembly.

3. In the method of making and assembling a key assembly of claim 2, in step (f), concurrently molding a logo in the concurrently-being-molded logo recess on at least one side surface of the key head cover being molded so that the logo in the logo recess is visible on the completed key assembly.

4. The method of making and assembling a key assembly as set forth in claim 2 in which, in step (f), at least one logo-receivable recess is molded into at least one side surface of the key head cover, and thereafter securing a disc containing a logo in place in each logo-receiving recess molded into the side surface of the key head cover with the logo being visible on the surface of the key head cover.

5. In the method of making and assembling a key assembly of claim 2 in step (f), concurrently molding the logo recess on at least one side surface of the key head cover being molded so that a logo, once mounted in the logo recess, is visible on the completed key assembly.

6. The method of making and assembling a key assembly as set forth in claim 5 in which:

in step (f), concurrently molding at least one logo on at least one side surface of the transponder holder being molded so that the logo is thereafter visible on the subassembly and on the completed key assembly;

and also in step (f), while molding the key head cover, concurrently molding an opening through at least one cover side surface which corresponds with the logo molded in place on the at least one side surface of the transponder holder, making the at least one logo visible from the exterior of the completed key assembly.

7. The method of making and assembling a key assembly as set forth in claim 2 which, in step (f), at least one logo is concurrently molded on at least one side surface of the transponder holder being molded so that the logo is visible on the first and second subassemblies, and also in step (f) while molding the key head cover molding a transparent window through at least one cover side surface which corresponds with the at least one logo molded in place on the at least one side surface of the transponder holder, making the at least one logo visible from the exterior of the key assembly.

8. The method of making and assembling a key assembly comprising the steps of:

(a) providing a key blank having one end-formed to define a generally U-shaped recess and snap-on protrusion means for receiving and mounting a transponder holder in the recess;

(b) molding a transponder holder and, in doing so, providing a resilient mounting section for a transponder and resilient holder location and securing sections resiliently connected with the mounting section, providing during the molding step openings in the location and securing sections for cooperating with the snap-on protrusion means of the key blank one end;

(c) providing a transponder;

(d) forming a first subassembly by inserting the transponder in the transponder holder mounting section, resiliently mounting and then retaining the transponder in a precise location in the transponder holder mounting section while the first subassembly may be stored and transported;

(e) then forming a second subassembly by inserting the first subassembly into the generally U-shaped recess of the key blank one end until the openings in the transponder holder location and securing sections mate with the protrusion means of the key blank one end and snap over those protrusion means to retain the second subassembly in a precise axial and lateral location relative to the key blank one end; and (f) placing the second subassembly in a molding machine and molding a key head cover thereabout while concurrently filling in any voids in the second subassembly with the material from which the key head cover is being molded, and also concurrently forming at least one logo area as a part of the key head cover forming the completed key assembly.

9. The method of making and assembling a key assembly as set forth in claim 8 in which:

in step (f), at least one logo is concurrently molded on a concurrently molded at least one logo area on at least one side surface of the transponder holder being molded so that the logo is visible on the first and second subassemblies, and also in step (f) while molding the key head cover molding a transparent window through each side surface of the key head cover which corresponds with the logo molded in place on each side surface of the transponder holder, making each logo visible from the exterior of the key assembly.

10. The method of making and assembling a key assembly, said method comprising the steps of:

(a) providing a key blank and a transponder holder and a transponder;

(b) forming a first subassembly comprising the key blank and the transponder holder by mounting the transponder holder in place on the head end of the key blank in a recess provided in the head end of the key blank for that purpose, and in forming the transponder holder forming a recess in the transponder holder extending axially of the key blank for receiving the transponder therein;

(c) forming a second subassembly wherein the transponder is inserted into the recess in the molded transponder holder, and providing means retaining the transponder in that recess as least while the second subassembly may be stored and transported;

(d) forming the completed key assembly by molding a key head cover in place containing the key blank head section, the transponder holder and the transponder retained therein, the material from which the key head cover is molded filling any voids while concurrently molding at least one logo area on at least one side surface of the key head cover being molded so that a logo placed on the at least one logo area is visible on the completed key assembly; and (e) allowing the material from which the key head cover is molded to harden in place so that the transponder holder and the transponder are embedded therein and are effectively unitary parts of the key head portion of the completed key assembly as contained in the key head cover.

11. The method of making and assembling a key assembly as set forth in claim 10 in which, in step (d), a logo is concurrently molded on at least one concurrently molded area on at least one side surface of the key head cover being molded so that the logo is visible on the completed key assembly.

12. The method of making and assembling a key assembly as set forth in claim 11 in which, in step (a), the transponder holder is formed by molding, and at least one logo is concurrently molded on at least one side surface of the transponder holder being molded so that the logo is visible on the first and second subassemblies, and in step (d), while molding the key head cover, concurrently molding an opening through each side surface which corresponds with the logo molded in place on each side surface of the transponder holder, making each logo visible from the exterior of the completed key assembly.

13. The method of making and assembling a key assembly as set forth in claimed 10 in which:

in step (a), the transponder holder is formed by molding, and in step (d), the at least one logo area is at least one recess molded into at least one side surface of the key head cover, and, after step (e) is accomplished, securing a disc containing a logo in place in each logo-receiving recess molded into the side surface of the key head cover with the logo being visible on the surface of the key head cover.

14. The method of making and assembling a key assembly comprising the steps of:

(a) providing a transponder;

(b) molding a transponder holder providing a mounting section for a transponder;

(c) providing a key blank having one end formed to define a generally U-shaped recess and means for receiving and mounting a transponder holder in the recess;

(d) forming a subassembly composed of the transponder, the transponder holder and the key blank and retaining the. transponder in a precise location in the transponder holder and in the key blank while the subassembly may be stored and transported;

(e) placing the subassembly in a molding machine and molding a key head cover about key blank one end and the transponder holder .and the transponder while concurrently filling in any voids located in the U-shaped recess with the material from which the key head cover is being molded and also concurrently molding at least one logo-receivable area so that a logo placed in that area is visible on the completed key assembly.

15. The method of ,making and assembling a key assembly as set forth in claim 14 and further comprising the additional steps:

(f) at least one such concurrently molded logo-receivable area is a logo-receivable recess molded into at least one side surface of the key head cover, and thereafter (g) a disc containing a logo is secured in place in each logo-receivable recess molded into the side surface of the key head cover with the logo being visible on the surface of the key head cover, forming the completed key assembly.

16. The method of making and assembling a key assembly comprising the steps of:

(a) providing a transponder;

(b) molding a transponder holder providing a mounting section for a transponder;

(c) providing a key blank having one end formed to define a generally U-shaped recess and means for receiving and mounting a transponder holder in the recess;

(d) forming a subassembly composed of the transponder, the transponder holder and the key blank and retaining the transponder in a precise location in the transponder holder and in the key blank while the subassembly may be stored and transported; and (e) placing the subassembly in a molding machine and molding a key head cover about the key blank one end and the transponder holder and the transponder while concurrently filling in any voids located in the U-shaped recess with the material from which the key head cover is being molded and also concurrently molding a logo intregally on each of the opposite sides of the transponder holder during the molding step of making the transponder holder so that the logo is visible on the completed key assembly, forming the completed key assembly.

17. The method of making and assembling a key assembly as set forth in claim 16, further comprising step (f) wherein the key head cover is provided with side openings corresponding with the logos molded on the transponder holder so that the logos are visible through the key head cover openings.

18. The method of making and assembling a key assembly as set forth in claim 16, further comprising in step (a) providing the key head cover with sufficiently transparent side surfaces corresponding with the logos molded on the transponder holder so that the logos are each visible through one of the key head cover side surfaces.

* * * * *